US009899761B2

(12) United States Patent
Schroll et al.

(10) Patent No.: US 9,899,761 B2
(45) Date of Patent: Feb. 20, 2018

(54) CONNECTOR SYSTEM WITH CONNECTOR POSITION ASSURANCE

(71) Applicant: TYCO ELECTRONICS CORPORATION, Berwyn, PA (US)

(72) Inventors: Neil Franklin Schroll, Mount Joy, PA (US); John Wesley Hall, Harrisburg, PA (US); David James Lane, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 15 days.

(21) Appl. No.: 15/003,261

(22) Filed: Jan. 21, 2016

(65) Prior Publication Data

US 2017/0214168 A1 Jul. 27, 2017

(51) Int. Cl.
*H01R 13/629* (2006.01)
*H01R 13/436* (2006.01)
*H01R 13/627* (2006.01)

(52) U.S. Cl.
CPC ..... *H01R 13/4365* (2013.01); *H01R 13/6271* (2013.01); *H01R 13/62927* (2013.01)

(58) Field of Classification Search
CPC ..... H01R 13/5365; H01R 13/6271; H01R 13/629274; H01R 13/62927; H01R 13/4365
USPC ..... 439/352, 752, 438
See application file for complete search history.

(56) References Cited

U.S. PATENT DOCUMENTS 5,681,178 A * 10/1997 Kunkle ..... H01R 13/641 439/352
5,759,058 A * 6/1998 Childs ..... H01R 13/641 439/352
6,068,507 A * 5/2000 Popa ..... H01R 13/641 439/352
6,491,542 B1 12/2002 Zerebilov
8,888,521 B2 * 11/2014 Puckett ..... H01R 13/641 439/352

FOREIGN PATENT DOCUMENTS

EP 1708310 A1 10/2006
KR 101482973 B1 1/2015

OTHER PUBLICATIONS

International Search Report, International Application No. PCT/US2016/067670, International Filing Date Dec. 20, 2016.

* cited by examiner

*Primary Examiner* — Edwin A. Leon
*Assistant Examiner* — Paul Baillargeon

(57) ABSTRACT

A connector system is provided that includes an electrical connector having a housing, a connector position assurance (CPA) element, and an actuator. The housing defines a socket that receives a mating connector. The CPA element is slidable relative to the housing between a released position and a locked position. The actuator is mounted on the housing in operable engagement with the CPA element. The actuator is moved from a blocking position to a clearance position as the mating connector is loaded into the socket. The actuator in the blocking position mechanically blocks the CPA element from being moved between the released position and the locked position. The actuator in the clearance position allows the CPA element to be moved between the released position and the locked position. The actuator attains the clearance position responsive to the mating connector being fully loaded in the housing.

20 Claims, 8 Drawing Sheets

CONNECTOR SYSTEM WITH CONNECTOR POSITION ASSURANCE

BACKGROUND OF THE INVENTION

The subject matter herein relates generally to connector systems, and more specifically to connector systems that provide connector position assurance.

In some connector systems, a coupling mechanism is used when a first connector is mated to a second connector to secure the first and second connectors together. The first and second connectors are secured together to ensure that the connector system can withstand forces that would tend to pull the connectors apart and break the conductive pathway that is formed between the connectors when mated to each other. In some embodiments, the coupling mechanism is defined by a latch on one connector that engages a catch of a mating connector to fully mate the two connectors.

It is important to ensure that the mated connectors in a respective connector system are fully mated to one another to avoid operating errors due to breaks in the conductive pathway. The connector system may be used in a complex manufactured product, such as an automobile for example. If the connectors in the connector system are not fully mated to each other during assembly of the automobile, the error eventually caused by the break in the conductive pathway may be difficult to discover and/or difficult and costly to fix. For example, it may be difficult to access the faulty connectors in the automobile.

Due to physical characteristics such as small size and shielded conductors, it may be difficult for a worker (or even a machine) to accurately identify whether two mating connectors are fully mated together at an assembly facility. For example, two connectors that are not fully mated to each other may only be a fraction of an inch off from the fully mated positions of the connectors, which may be difficult for the worker and/or the machine to identify. A need remains for a connector system that provides assurance that two connectors are fully mated to each other in order to avoid errors caused by breaks in the conductive pathway defined by the connectors.

BRIEF DESCRIPTION OF THE INVENTION

In an embodiment, an electrical connector is provided that includes a housing, a connector position assurance (CPA) element, and an actuator. The housing has a front end and defines a socket at the front end that is configured to receive a mating connector therein. The CPA element is mounted on the housing. The CPA element is slidable relative to the housing between a released position and a locked position. The CPA element includes a base and at least a first runner extending from the base. The actuator is mounted on the housing in operable engagement with the CPA element. The actuator has at least a first leg. The actuator is movable between a blocking position and a clearance position. The first leg of the actuator engages the first runner when the actuator is in the blocking position to mechanically block the CPA element from being moved between the released position and the locked position. The CPA element is movable between the released position and the locked position when the actuator is in the clearance position. The actuator is moved from the blocking position to the clearance position by the mating connector as the mating connector is loaded into the socket. The actuator attains the clearance position responsive to the mating connector being fully loaded in the housing.

In an embodiment, an electrical connector is provided that includes a housing, a CPA element, and an actuator. The housing has a front end and defines a socket at the front end that is configured to receive a mating connector therein. The housing further includes a deflectable primary latch that engages a catch of the mating connector when the mating connector is fully loaded in the socket to secure the housing to the mating connector. The CPA element is mounted on the housing. The CPA element is slidable relative to the housing between a released position and a locked position. The CPA element in the released position is pivotable relative to the housing about a fulcrum. The CPA element includes a base and at least a first runner extending from the base. A portion of the first runner between the fulcrum and a distal end of the first runner extends under the primary latch. Downward movement of the base pivots the CPA element such that the portion of the first runner lifts the primary latch over the catch of the mating connector to at least one of secure the housing to the mating connector or disconnect the housing from the mating connector. The actuator is mounted on the housing in operable engagement with the CPA element. The actuator is movable between a blocking position and a clearance position. The actuator in the blocking position is configured to engage the first runner to mechanically block the CPA element from being moved between the released position and the locked position. The CPA element is movable between the released position and the locked position when the actuator is in the clearance position. The actuator is moved from the blocking position to the clearance position by the mating connector as the mating connector is loaded into the socket. The actuator attains the clearance position responsive to the mating connector being fully loaded in the housing.

In an embodiment, a connector system is provided that includes a first electrical connector and a second electrical connector. The first electrical connector has a male housing extending from a mating end to a back end. The male housing includes a rib protruding outward from an outer surface thereof. The second electrical connector includes a female housing, a CPA element, and an actuator. The female housing extends from a front end to a rear end. The female housing defines a socket that is open at the front end. The socket is configured to receive the male housing therein to mate the first and second electrical connectors. The CPA element is mounted on the female housing. The CPA element is slidable relative to the female housing between a released position and a locked position. The CPA element includes a base and at least a first runner extending from the base. The actuator is mounted on the female housing in operable engagement with the CPA element. The actuator is movable between a blocking position and a clearance position. The actuator is biased towards the blocking position. The actuator has at least a first leg that engages the first runner when the actuator is in the blocking position to mechanically block the CPA element from being moved between the released position and the locked position. The CPA element is movable between the released position and the locked position when the actuator is in the clearance position. The rib of the male housing engages the actuator and moves the actuator from the blocking position to the clearance position as the male housing is loaded into the socket. The actuator attains the clearance position responsive to the male housing being fully loaded in the female housing.

DETAILED DESCRIPTION OF THE INVENTION

One or more embodiments described herein provide a connector system having an electrical connector that includes a connector position assurance (CPA) element. The CPA element is movable between a released position and a locked position. For example, the CPA element can move from the released position to the locked position and from the locked position to the released position. The CPA element is configured to only be movable between the released position and the locked position in response to a mating electrical connector being fully mated to the electrical connector. For example, until the mating electrical connector is fully mated with the electrical connector, the CPA element is restricted from moving from the released position to the locked position, or vice-versa depending on the particular embodiment. The CPA element is used to verify that the electrical connectors are fully mated by providing sensory (for example, tactile, visual, audible, etc.) feedback to a worker or a robot assembling the connector system.

Figure 1:
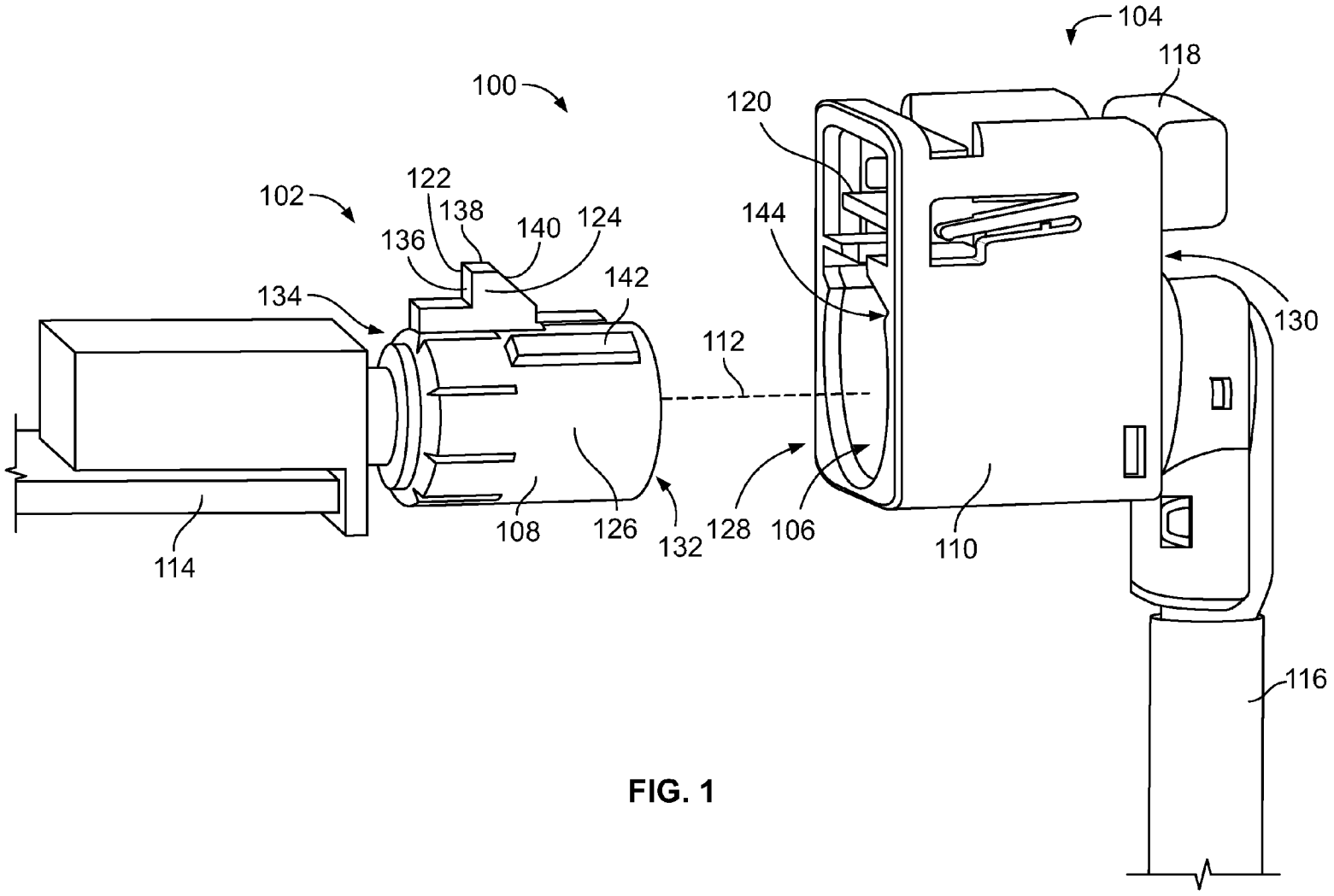
FIG. 1 is a perspective view of a connector system formed in accordance with an embodiment.

FIG. 1 is a perspective view of a connector system 100 formed in accordance with an embodiment. The connector system 100 includes a first electrical connector 102 and a second electrical connector 104. In the illustrated embodiment, the first electrical connector 102 is a male connector, and the second electrical connector 104 is a female connector, such that a portion of the first electrical connector 102 is received within a socket 106 of the second electrical connector 104 during a mating operation. More specifically, a male housing 108 of the first connector 102 is received within the socket 106, which is defined by a female housing 110 of the second connector 104. Although shown as unmated in FIG. 1, the first and second connectors 102, 104 are poised for mating along a mating axis 112. As used herein, the first electrical connector 102 is referred to as male connector 102 or mating connector 102, and the second electrical connector 104 is referred to as female connector 104 or connector 104.

The connector system 100 may be used in numerous applications across various industries, such as the automotive industry, the home appliance industry, the aviation industry, and the like, to electrically couple two or more devices and/or electrical components. For example, in the automotive industry, the electrical connectors 102, 104 may be used for radio frequency communications, such as to electrically connect an antenna to a controller and/or processing device.

The male connector 102 and the female connector 104 each electrically connect to different electrical components and provide a conductive pathway between the corresponding electrical components. In the illustrated embodiment, the male connector 102 is edge-mounted on a printed circuit board 114, and the female connector 104 is electrically connected to a conductive cable or wire 116, such as a coaxial cable. In an alternative embodiment, the female connector 104 may be mounted to a circuit board and/or the male connector 102 may be terminated to a cable. The printed circuit board 114 and the cable 116 are each electrically terminated (e.g., crimped, soldered, etc.) to electrical contacts (not shown) of the respective connectors 102, 104 that engage each other when the connectors 102, 104 are mated. Various electrical signals conveying power, control, data, or the like, may be transmitted through the connectors 102, 104 between the printed circuit board 114 and the cable 116.

The female connector 104 has a right angle shape, although the angle defined by the female connector 104 need not be approximately 90°. For example, the mating axis 112 along which the male connector 102 is loaded into the socket 106 is generally perpendicular to the orientation of the cable 116 exiting the female connector 104. Due to the right angle shape, the female connector 104 has a limited length along the mating axis 112. Thus, there is limited available area along the length for installing a connector position assurance (CPA) device that is used to verify whether the male connector 102 and the female connector 104 are fully mated during a mating operation.

The female housing 110 of the female connector 104 extends between a front end 128 and a rear end 130. The front end 128 is a mating end that faces the male connector 102. The socket 106 extends through the female housing 110 between the front end 128 and the rear end 130. The socket 106 is open at the front end 128. In one or more embodiments, the female connector 104 includes a CPA element 118 that is mounted to the female housing 110. The CPA element 118 is disposed radially outward of the socket 106, as opposed to being in-line with the socket 106. The CPA element 118 is disposed above the socket 106 in the illustrated orientation. The CPA element 118 is operably coupled to a deflectable primary latch 120 of the female housing 110. The primary latch 120 is configured to engage a catch 122 of the male connector 102 to secure the female housing 110 to the male connector 102. The engagement between the primary latch 120 and the catch 122 is designed to absorb and withstand forces incidental to normal use that pull the connectors 102, 104 apart. The primary latch 120 is configured to deflect radially relative to the socket 106. The primary latch 120 may deflect responsive to engagement with the male housing 108 as the male connector 102 is loaded into the socket 106. Additionally, or alternatively, the primary latch 120 may deflect due to pivoting or rotation of the CPA element 118, as described in more detail below.

The male housing 108 extends between a mating end 132 and a back end 134. The male housing 108 is loaded in the socket 106 such that the mating end 132 is received in the socket 106 first. The back end 134 may or may not enter the socket 106. In the illustrated embodiment, the male housing 108 is a nose cone that has a generally cylindrical shape. The male housing 108 includes a rib 124 that projects from an outer surface 126 thereof. The rib 124 is configured to engage the primary latch 120. The rib 124 includes a catch surface 136 that defines the catch 122. The catch surface 136 faces the back end 134. The rib 124 may deflect the primary latch 120 as the male connector 102 is loaded. For example, a top side 138 of the rib 124 may define a ramp 140 that gradually increases the deflection of the primary latch 120 as the male connector 102 moves along the mating axis 112 towards a fully loaded position. The male housing 108 also includes at least one keying ridge 142 that projects from the outer surface 126. Each keying ridge 142 is configured to be received in a corresponding key groove 144 in the socket 106 to ensure that the male housing 108 properly aligns with the female housing 110 during the mating operation.

Figure 2:
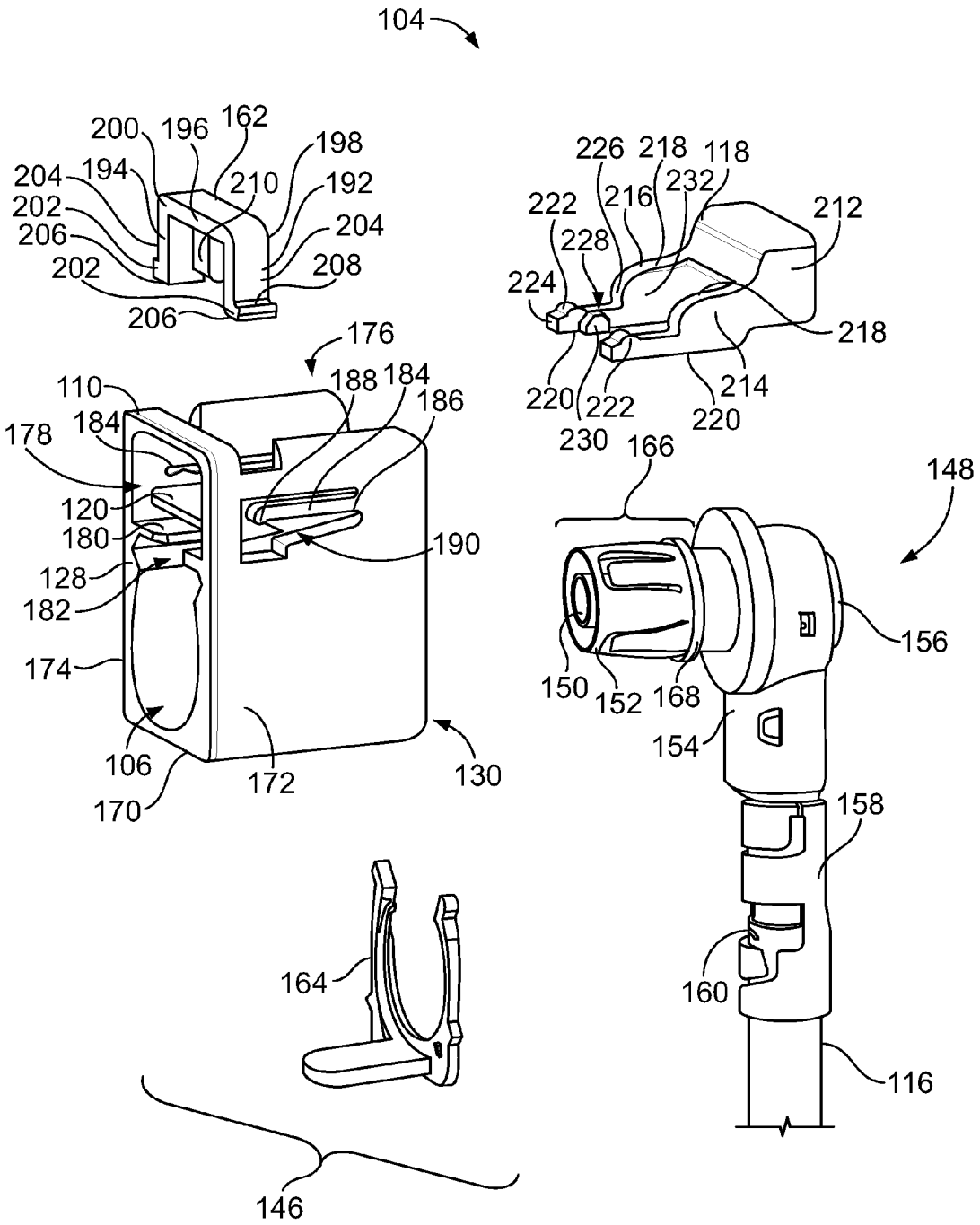
FIG. 2 is a partially exploded view of a female connector of the connector system according to an embodiment.

FIG. 2 is a partially exploded view of the female connector 104 according to an embodiment. The female connector 104 includes a housing assembly 146 and a contact assembly 148. In the illustrated embodiment, the housing assembly 146 is exploded, and the contact assembly 148 is intact. The housing assembly 146 includes the female housing 110, the CPA element 118, an actuator 162, and an optional retainer clip 164. The contact assembly 148 may include a center contact (not shown), a dielectric 150 surrounding the center contact, an outer contact 152 surrounding the dielectric 150, a front shield 154, and a rear shield 156. The dielectric 150 provides insulation between the center contact and the outer contact 152. The front and rear shields 154, 156 are electrically conductive and provide shielding to reduce electromagnetic interference such as cross-talk that could degrade the signal quality of the signals transmitted through the connector 104. The contact assembly 148 is terminated to the cable 116 by a ferrule 158 that is crimped around the front and rear shields 154, 156 and an outer jacket 160 of the cable 116. The ferrule 158 may also be crimped around a cable braid (not shown) of the cable 116.

The connector 104 is assembled by inserting a contact segment 166 of the contact assembly 148 into the female housing 110 through the rear end 130. The contact segment 166 includes the center contact, the dielectric 150, and the outer contact 152. The contact segment 166 is configured to engage corresponding components of the male connector 102 (shown in FIG. 1) to electrically connect the male connector 102 and the female connector 104 when the male connector 102 is fully loaded into the socket 106. The retainer clip 164 is inserted into the female housing 110 subsequent to the contact segment 166 in order to secure the contact assembly 148 to the housing 110. For example, the retainer clip 164 may engage a flange 168 of the front shield 154 to retain the contact segment 166 in the housing 110.

The components of the housing 110, CPA element 118, and actuator 162 are described in detail below. The interoperability of the components will be explained with reference to succeeding figures. In an embodiment, the housing 110, CPA element 118, and actuator 162 are electrically insulative and composed of one or more dielectric materials, such as plastics. Alternatively, the CPA element 118 and/or the actuator 162 are electrically conductive and composed of one or more metals. The housing 110, CPA element 118, and actuator 162 may be formed of a molding process.

The housing 110 includes a bottom wall 170, a first side wall 172, and an opposite second side wall 174. A top end 176 of the housing 110 is at least partially open. As used herein, relative or spatial terms such as "top," "bottom," "front," "rear," "first," and "second" are only used to distinguish the referenced elements of the connector system 100 and do not require particular positions or orientations relative to the direction of gravity and/or relative to the surrounding environment of the connector system 100. The housing 110 defines a latching zone 178 above the socket 106 (for example, between the socket 106 and the top end 176). The primary latch 120 and both the actuator 162 and the CPA element 118 (when mounted to the housing 110) are disposed in the latching zone 178. A platform 180 separates the latching zone 178 from the socket 106 such that the platform 180 is disposed between the primary latch 120 and the socket 106. The platform 180 defines a notch 182 extending rearward from the front end 128. The notch 182 is configured to accommodate the rib 124 (shown in FIG. 1) of the male housing 108 (FIG. 1) therein as the male housing 108 enters the socket 106.

The housing 110 also includes a cantilevered beam 184 along each of the first side wall 172 and the second side wall 174. Each cantilevered beam 184 extends from a fixed end 186 that is attached to the respective side wall 172, 174 to a distal, free end 188 that is not attached to the respective side wall 172, 174. In the illustrated embodiment, the free end 188 is disposed more proximate to the front end 128 of the housing 110 than the proximity of the fixed end 186 to the front end 128. Optionally, the cantilevered beams 184 are formed integral to the respective side walls 172, 174. For example, instead of coupling discrete beams onto the walls 172, 174, the cantilevered beams 184 are formed by removing portions of the walls 172, 174 surrounding the beams 184. Thus, the cantilevered beam 184 extends into a window 190 defined in the respective wall 172, 174. The cantilevered beams 184 are configured to deflect relative to the housing 110 within the respective window 190. In an alternative embodiment, only one of the first side wall 172 or the second side wall 174, but not both, includes a cantilevered beam 184.

The actuator 162 includes a first leg 192 and a second leg 194. The first and second legs 192, 194 both extend from a cross-bar 196. For example, the legs 192, 194 may extend from opposite first and second ends 198, 200 of the cross-bar 196. The legs 192, 194 are oriented to extend generally parallel to one another and in the same general direction from the cross-bar 196. The legs 192, 194 are spaced apart from each other along the length of the cross-bar 196 such that the legs 192, 194 are configured to straddle the primary latch 120. In an embodiment, the legs 192, 194 each include a ledge 202 that protrudes outward from an outer side 204 of the respective leg 192, 194. The ledge 202 is disposed proximate to a bottom (or distal end) 206 of the respective leg 192, 194. When mounted to the housing 110, the outer side 204 of the first leg 192 faces the first side wall 172, and the ledge 202 of the first leg 192 is received in the window 190 of the first side wall 172. The cantilevered beam 184 along the first side wall 172 engages and applies a biasing force on a top 208 of the ledge 202 of the first leg 192. Although not shown, the ledge 202 of the second leg 194 may similarly engage the cantilevered beam 184 along the second side wall 174.

In an embodiment, the actuator 162 further includes a post 210 disposed between the first and second legs 192, 194. The post 210 extends from the cross-bar 196 in approximately the same direction as the legs 192, 194. The post 210 is configured to be engaged by the rib 124 (shown in FIG. 1) of the male connector 102 (FIG. 1) during the mating operation.

The CPA element 118 includes a base 212 and first and second runners 214, 216 extending from the base 212. The runners 214, 216 have similar, if not identical, shapes that mirror each other. The runners 214, 216 extend generally parallel to one another and in the same general direction from the base 212. The base 212 is a bulbous, knob-like structure that may be at least partially curved. The large, curved structure of the base 212 provides a place of contact for an operator to grip and/or hold the CPA element 118 in order to actuate (for example, slide and/or pivot) the CPA element 118, as described in more detail herein. The first and second runners 214, 216 are spaced apart from each other to straddle the primary latch 120 when mounted to the housing 110. The first and second runners 214, 216 are spaced apart by a distance that is approximately equal to a distance separating the first and second legs 192, 194 of the actuator 162. Each runner 214, 216 has a top side 218 and an opposite bottom side 220. The bottom side 220 is configured to contact and slide along the platform 180 of the housing 110. The top side 218 has a contoured surface. For example, the top side 218 includes a detent 222 proximate to a distal end 224 of the respective runner 214, 216. The top side 218 also defines a step 226 disposed between the detent 222 and the base 212. The area of the top side 218 between the detent 222 and the step 226 defines a seat 228. The seat 228 is configured to accommodate the bottom 206 of a corresponding leg 192, 194, as described in more detail herein.

At least a portion of each runner 214, 216 extends towards the opposing runner 214, 216. In an embodiment, both runners 214, 216 include a lug 230 that defines the portion that extends toward the opposing runner 214, 216. Only the lug 230 of the second runner 216 is visible in FIG. 2. The lug 230 is disposed more proximate to the distal end 224 of the respective runner 214, 216 than the proximity of the lug 230 to the base 212. The lug 230 protrudes from an inner side 232 of the respective runner 214, 216 that faces the opposing runner 214, 216. Upon mounting the CPA element 118 to the housing 110, the lugs 230 are configured to extend underneath the primary latch 120 between the latch 120 and the platform 180.

In the illustrated embodiment, the actuator 162 includes two legs 192, 194 and the CPA element 118 includes two runners 214, 216. In an alternative embodiment, however, the actuator 162 may include only one leg and the CPA element 118 may include only one runner.

Figure 3:
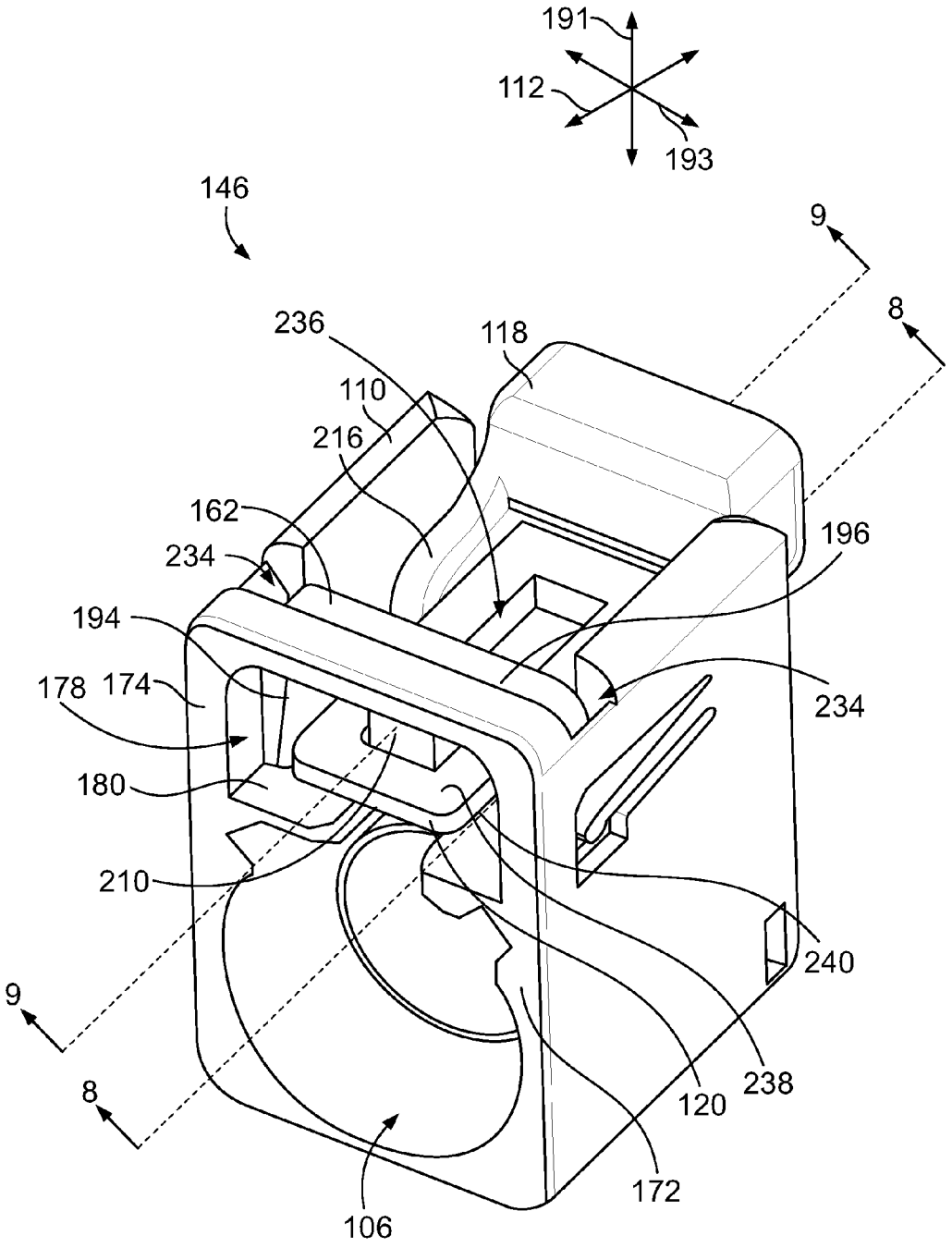
FIG. 3 is a perspective view of a housing assembly of the female connector in an assembled state according to an embodiment.

FIG. 3 is a perspective view of the housing assembly 146 in an assembled state according to an embodiment. The housing assembly 146 is oriented with respect to a vertical or elevation axis 191, a lateral axis 193, and the mating axis 112. The axes 191, 193, 112 are mutually perpendicular. Although the elevation axis 191 appears to extend in a generally parallel to gravity, it is understood that the axes 191, 193, 112 are not required to have any particular orientation with respect to gravity.

The actuator 162 and the CPA element 118 are mounted to the housing 110 in the latching zone 178. The primary latch 120 is generally centrally located along the lateral axis 193 between the first and second side walls 172, 174. The first leg 192 (shown in FIG. 2) and the second leg 194 of the actuator 162 straddle the primary latch 120 such that the first leg 192 is disposed between the latch 120 and the first side wall 172 and the second legs 194 is disposed between the latch 120 and the second side wall 174. The first runner 214 (shown in FIG. 2) and the second runner 216 of the CPA element 118 also straddle the primary latch 120. In an embodiment, the primary latch 120 defines an aperture 236 that extends through the latch 120 from a top side 238 to a bottom side 240 of the latch 120. The aperture 236 is elongated along the mating axis 112. The cross-bar 196 is disposed above the top side 238 of the primary latch 120. The post 210 of the actuator 162 extends downward into the aperture 236.

The actuator 162 is movable relative to the housing 110 between a blocking position (depicted in FIGS. 3, 4, and 7-9) and a clearance position (depicted in FIGS. 5, 6, and 10-13). The actuator 162 is in the blocking position in FIG. 3. The actuator 162 is configured to move vertically between the blocking position and the clearance position. For example, each of the first and second side walls 172, 174 defines a groove 234 that extends along the vertical axis 191 and receives a corresponding one of the first and second legs 192, 194 therein. The grooves 234 define a track for the actuator 162 to allow movement of the actuator 162 along the vertical axis 191 while preventing movement of the actuator 162 along the mating axis 112 and the lateral axis 193.

The CPA element 118 is movable relative to the housing 110 between a released position (depicted in FIGS. 3-5 and 7-10) and a locked position (depicted in FIGS. 6 and 11-13). The CPA element 118 is in the released position in FIG. 3. The CPA element 118 is configured to move along the mating axis 112 between the released and locked positions. The runners 214, 216 of the CPA element 118 slide along the platform 180. The CPA element 118 is moved via operator involvement, such as by an operator pushing or pulling the base 212.

In an embodiment, the actuator 162 is in the blocking position and the CPA element 118 is in the released position when the male connector 102 (shown in FIG. 1) is not fully loaded in the socket 106 of the female housing 110. For example, the actuator 162 is biased towards the blocking position. When the actuator 162 is in the blocking position, the actuator 162 mechanically blocks the CPA element 118 from moving from the released position to the locked position. Thus, the CPA element 118 is not permitted to be moved from the released position to the locked position. As the male connector 102 is loaded into the socket 106 along the mating axis 112, the male connector 102 engages the actuator 162 and moves the actuator 162 from the blocking position towards the clearance position. The actuator 162 does not attain the clearance position until the male connector 102 reaches a fully loaded position relative to the housing 110. In the fully loaded position, the male connector 102 is properly connected to the female connector 104 (shown in FIG. 1). For example, the primary latch 120 does not engage the catch surface 136 (shown in FIG. 1) of the rib 124 (FIG. 1) until the male connector 102 is in the fully loaded position.

When the actuator 162 is in the clearance position, the actuator 162 does not block movement of the CPA element 118 from the released position to the locked position. Thus, an operator is able to move the CPA element 118 to the locked position. Since the actuator 162 is only in the clearance position when the male connector 102 (shown in FIG. 1) is fully loaded in the female housing 110, the CPA element 118 is movable from the released position to the locked position when the male connector 102 is fully loaded. Therefore, the ability to move the CPA element 118 to the locked position after a mating operation between a male connector 102 and a female connector 104 (shown in FIG. 1) indicates that the connectors 102, 104 are fully and properly mated to each other. In the illustrated embodiment, the locked position of the CPA element 118 represents an assurance position of the connector system 100 (shown in FIG. 1) because the state of the CPA element 118 in the locked position provides assurance that the connectors 102, 104 are fully and properly mated. The movement of the CPA element 118 provides a sensory notification to the operator, such as a visual (seeing the CPA element 118 in the locked position), tactile (feeling the CPA element 118 move to the locked position), and/or audible (hearing the CPA element 118 move to the locked position) indicator. In an alternative embodiment, such as described below with reference to FIG. 14, the CPA element 118 may be initially located in the locked position, and may move from the locked position to the released position upon the actuator 162 attaining the clearance position. In this alternative embodiment, the released position of the CPA element 118 represents the assurance position of the connector system 100.

Figure 4:
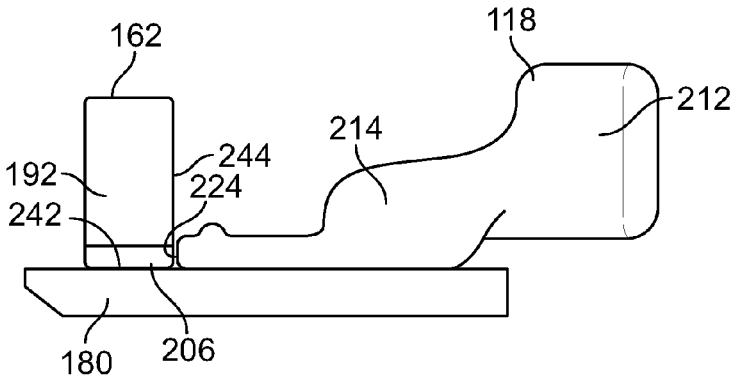
FIG. 4 is a schematic side view of an actuator and a CPA element relative to a platform of the female housing in a pre-mated stage.
Figure 5:
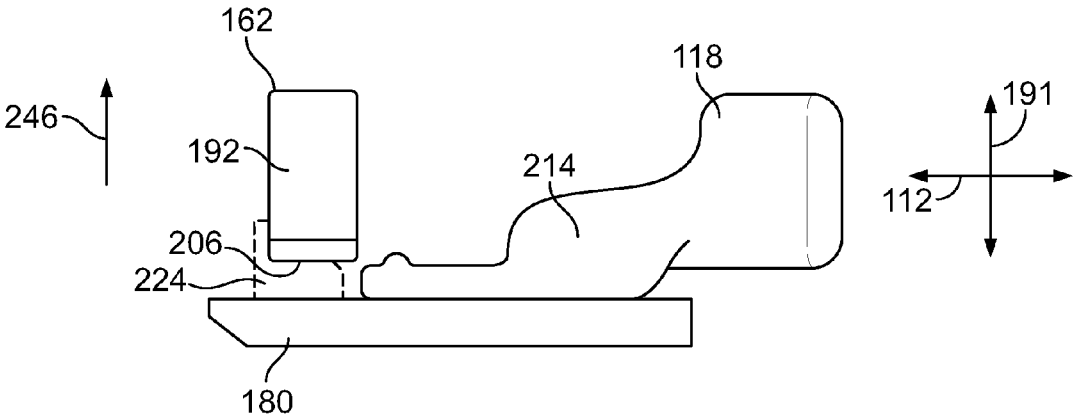
FIG. 5 is a schematic side view of the actuator and the CPA element relative to the platform of the female housing in an initial mated stage.
Figure 6:
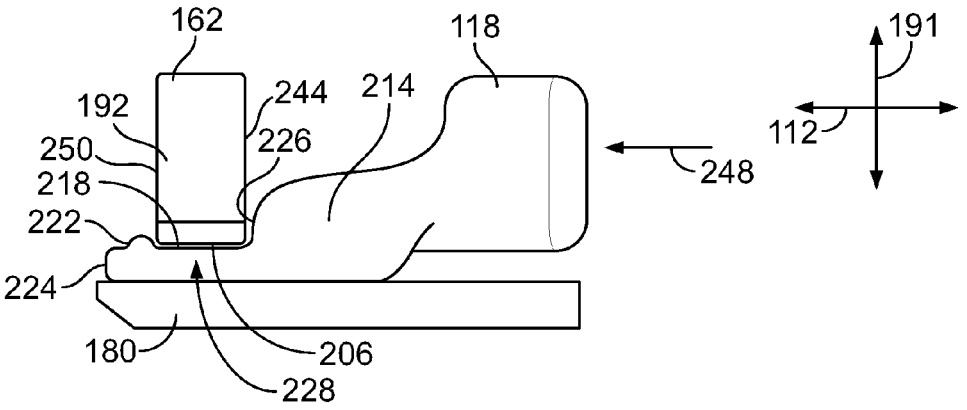
FIG. 6 is a schematic side view of the actuator and the CPA element relative to the platform of the female housing in a final mated stage.

FIGS. 4-6 illustrate schematic side views of the actuator 162 and the CPA element 118 relative to the platform 180 of the female housing 110 (shown in FIG. 3) at various stages during a mating operation according to an embodiment. In the illustrated side views, only the first leg 192 of the actuator 162 is visible. Similarly, only the first runner 214 and the base 212 of the CPA element 118 are visible. The following description of the first leg 192 and the first runner 214 may also apply to the second leg 194 (shown in FIG. 2) and the second runner 216 (FIG. 2).

FIG. 4 shows a pre-mated stage before the male connector 102 (shown in FIG. 1) is mated to the female housing 110 (FIG. 3). The actuator 162 is in the blocking position, and the CPA element 118 is in the released position. When the actuator 162 is in the blocking position, the leg 192 rests on the platform 180 such that the bottom 206 of the leg 192 engages a top surface 242 of the platform 180. The leg 192 is located in a path of the runner 214. Therefore, attempted movement of the CPA element 118 from the released position to the locked position would cause the distal end 224 of the runner 214 to abut against a first side 244 of the leg 192, which mechanically blocks further movement of the CPA element 118 towards the locked position.

FIG. 5 shows an initial mated stage in which the male connector 102 (shown in FIG. 1) is fully mated to the female housing 110 (FIG. 3). The male connector 102 has moved the actuator 162 vertically in an unblocking direction 246 (parallel to the vertical axis 191) from the blocking position to the clearance position. The male connector 102 also supports and retains the actuator 162 in the clearance position. For example, the rib 124 (shown in phantom) of the male housing 108 (FIG. 1) engages the post 210 (FIG. 2) of the actuator 162 to lift and hold the actuator. In the clearance position, the bottom 206 of the leg 192 is spaced apart vertically from the platform 180 by a height that is sufficient to allow at least a portion of the runner 214 to pass under the leg 192. In the initial mated stage of the FIG. 5, although the CPA element 118 is allowed to move to the locked position, the CPA element 118 remains in the released position.

FIG. 6 shows a final mated stage. The actuator 162 is in the clearance position, and the CPA element 118 is in the locked position. The CPA element 118 has been moved (by an operator or a machine) in a locking direction 248 parallel to the mating axis 112 from the released position to the locked position. In the illustrated embodiment, the runner 214 of the CPA element 118 slides under the bottom 206 of the leg 192 along the platform 180 until the leg 192 aligns with the seat 228 of the runner 214. For example, the distal end 224 of the runner 214 and the detent 222 both protrude beyond a second side 250 of the leg 192 (that is opposite the first side 244). The detent 222 may engage the bottom 206 of the leg 192 as the detent 222 passes the leg 192 to provide tactile and/or audible feedback to an operator. The actuator 162 is biased downwards, so the bottom 206 of the leg 192 engages the top side 218 of the runner 214 at the seat 228. The step 226 of the runner 214 may engage the first side 244 to provide a hard stop that prevents further movement of the CPA element 118 in the locking direction 248. The detent 222 may be configured to engage the second side 250 of the leg 192 to provide a soft stop that restricts the CPA element 118 from unintentionally returning back to the released position. The soft stop provided by the detent 222 is configured to be overcome by a sufficient force to allow the CPA element 118 to be intentionally moved from the locked position to the released position.

Figure 7:
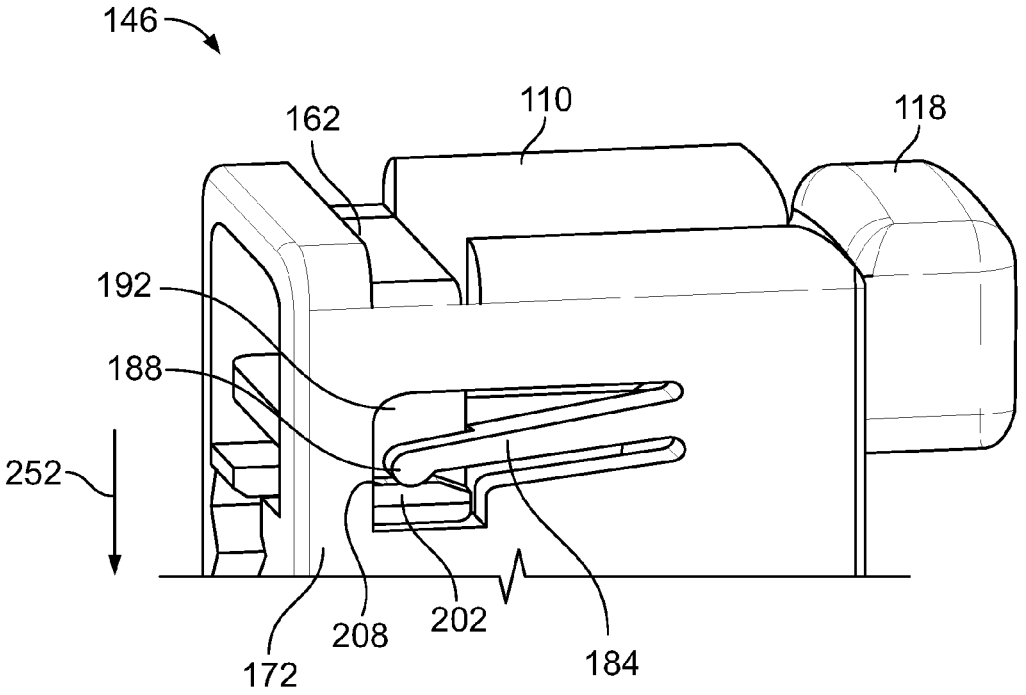
FIG. 7 is a side view of a portion of the housing assembly in the pre-mated stage.
Figure 8:
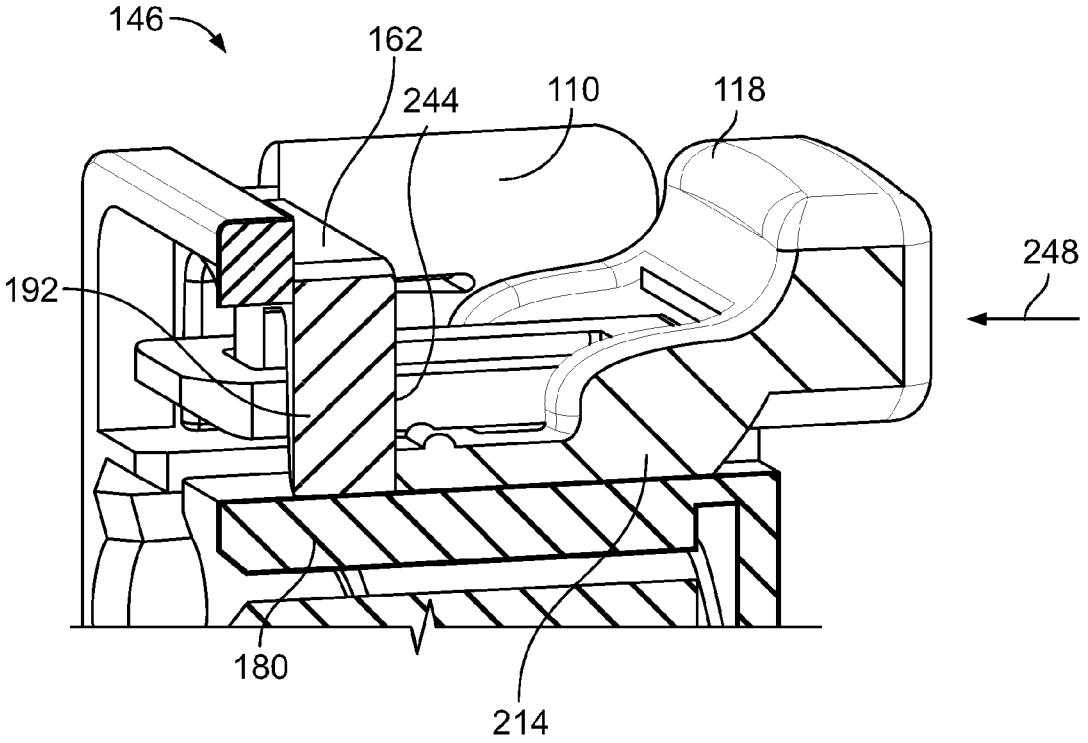
FIG. 8 is a cross-sectional view of a portion of the housing assembly in the pre-mated stage taken along line 8-8 shown in FIG. 3.
Figure 9:
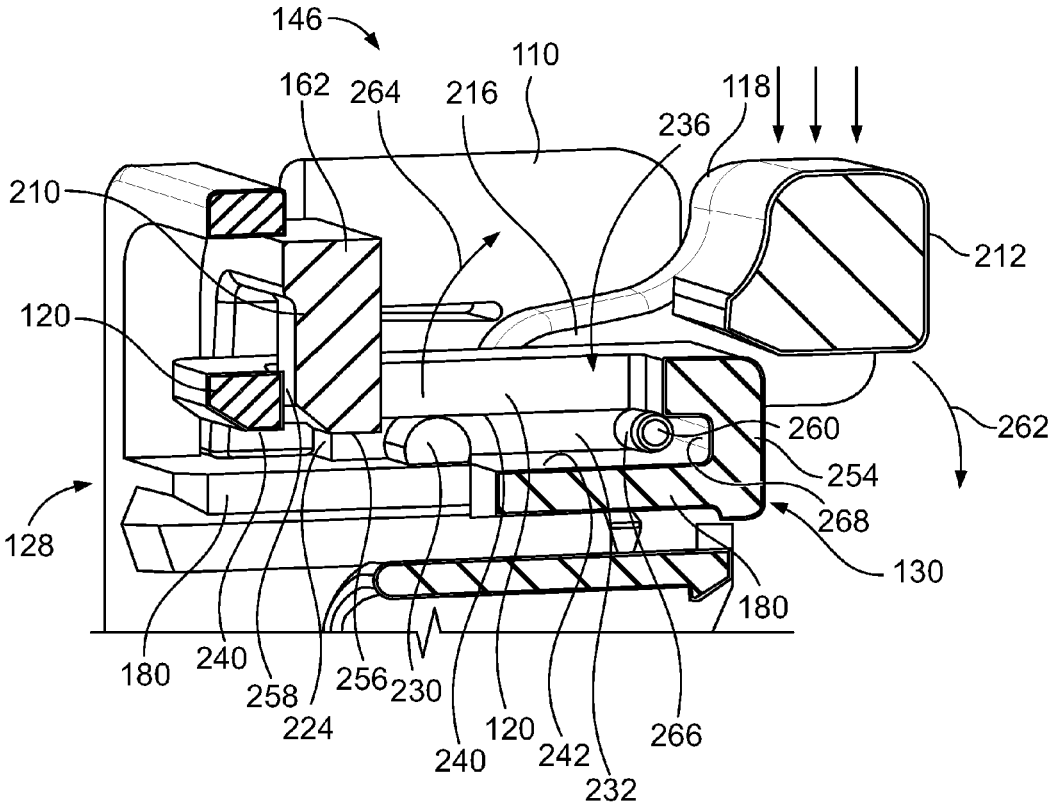
FIG. 9 is a cross-sectional view of a portion of the housing assembly in the pre-mated stage taken along line 9-9 shown in FIG. 3.

FIGS. 7-9 illustrate various views of portions of the housing assembly 146 in the pre-mated stage schematically shown in FIG. 4, in which the actuator 162 is in the blocking position and the CPA element 118 is in the released position. FIG. 7 is a side view of a portion of the housing assembly 146. FIG. 8 is a cross-sectional view of a portion of the housing assembly 146 taken along line 8-8 shown in FIG. 3. FIG. 9 is a cross-sectional view of a portion of the housing assembly 146 taken along line 9-9 shown in FIG. 3.

Figure 13:
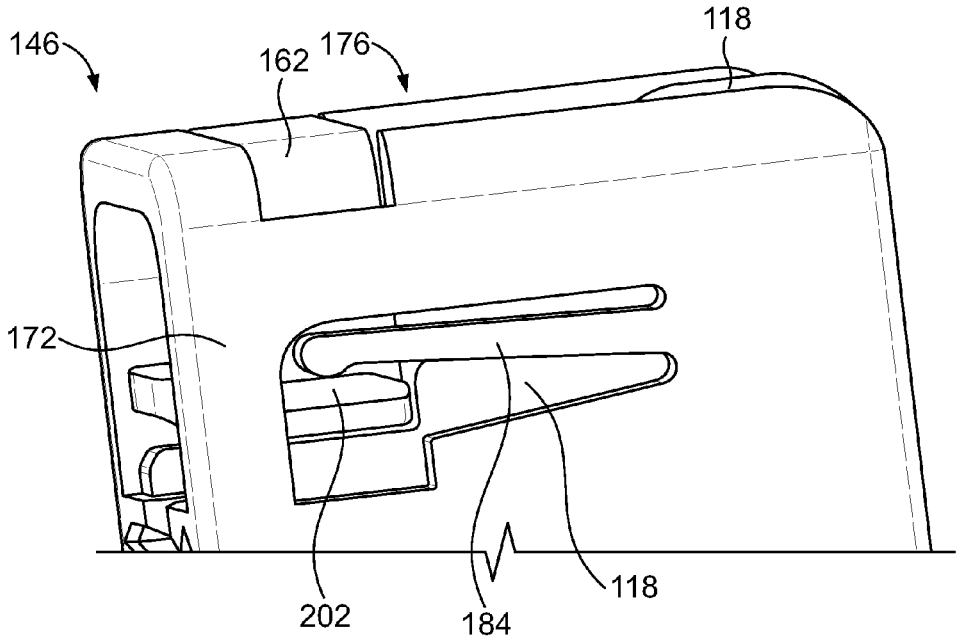
FIG. 13 is a side view of a portion of the housing assembly in the final mated stage.

Referring to FIG. 7, the cantilevered beam 184 of the first side wall 172 of the housing 110 engages the ledge 202 that protrudes from the first leg 192 of the actuator 162. The free end 188 engages the top 208 of the ledge 202 and applies a biasing force in a downward direction 252 towards the bottom wall 170 (shown in FIG. 2) of the housing 110. The cantilevered beam 184 biases the actuator 162 towards the blocking position. The cantilevered beam 184 is configured to deflect upwards as the actuator 162 is lifted to the clearance position by the male connector 102 (shown in FIG. 1), as depicted in FIG. 13. The cantilevered beam 184 maintains engagement with the ledge 202 throughout the mating operation and thereafter.

The cross-section in FIG. 8 extends through the first leg 192 of the actuator 162 and the first runner 214 of the CPA element 118. The illustrated embodiment resembles the schematic shown in FIG. 4. As shown in FIG. 8, the first leg 192 engages the platform 180 of the housing 110 in the path of the first runner 214, such that movement of the CPA element 118 in the locking direction 248 is not permitted beyond the first side 244 of the leg 192.

Referring now to FIG. 9, the cross-section extends through the post 210 of the actuator 162, the primary latch 120 of the housing 110, and the base 212 of the CPA element 118. The second runner 216 is visible, but the first runner 214 (shown in FIG. 2) is not. In the illustrated embodiment, the housing 110 includes a shoulder 254 that extends from the platform 180 at the rear end 130 of the housing 110. The primary latch 120 extends forward from the shoulder 254 and is spaced apart from the platform 180. The primary latch 120 extends generally parallel to the platform 180 when in an undeflected position, as shown in FIG. 9. The post 210 is received in the aperture 236 of the primary latch 120. A bottom 256 of the post 210 is disposed at approximately the same height from the platform 180 as the bottom side 240 of the primary latch 120. The primary latch 120 has a latching surface 258 that engages the catch or catch surface 136 (shown in FIG. 1) of the male connector 102 (FIG. 1). In the illustrated embodiment, the latching surface 258 is a front wall of the aperture 236 that faces the rear end 130 of the housing 110. The latching surface 258 faces the post 210 in the aperture 236. The primary latch 120 extends more proximate to the front end 128 of the housing 110 than the proximity of the actuator 162 to the front end 128, so the male connector 102 is configured to engage or at least extend beyond a front end 270 of the primary latch 120 prior to engaging the actuator 162. The post 210 is proximate to the latching surface 258 such that the male connector 102 engages the post 210 at the same time that the catch surface 136 engages the latching surface 258.

As shown in FIG. 9, the base 212 of the CPA element 118 extends beyond the rear end 130 of the housing 110 when the CPA element 118 is in the released position. In an embodiment, the CPA element 118 is pivotable relative to the housing 110. The CPA element 118 pivots about a fulcrum 260 that is disposed between the base 212 and the distal end 224 of the runner 216. A portion of the runner 216 between the fulcrum 260 and the distal end 224 extends under the primary latch 120. In the illustrated embodiment, the portion that extends under the primary latch 120 is the lug 230. A downward force on the base 212 pivots the CPA element 118 such that the base 212 moves in a downward arc 262 while the lug 230 moves in an upward arc 264. The lug 230 engages the bottom side 240 of the primary latch 120 and lifts the latch 120 upwards away from the platform 180. In an embodiment, the fulcrum 260 is a peg 266 of the CPA element 118 that extends from the inner side 232 of the runner 216. In addition to, or as an alternative to, serving as the fulcrum 260, the peg 266 may be configured to abut a back wall 268 of the shoulder 254 to provide a hard stop that limits the available movement of the CPA element 118 in the rearward direction. The peg 266 may engage the bottom side 240 of the primary latch 120, the top surface 242 of the platform 180, and/or the back wall 268 of the shoulder 254 when the CPA element 118 pivots. In an alternative embodiment, instead of using the peg 266 of the CPA element 118, the fulcrum 260 may be a component of the housing 110.

Figure 10:
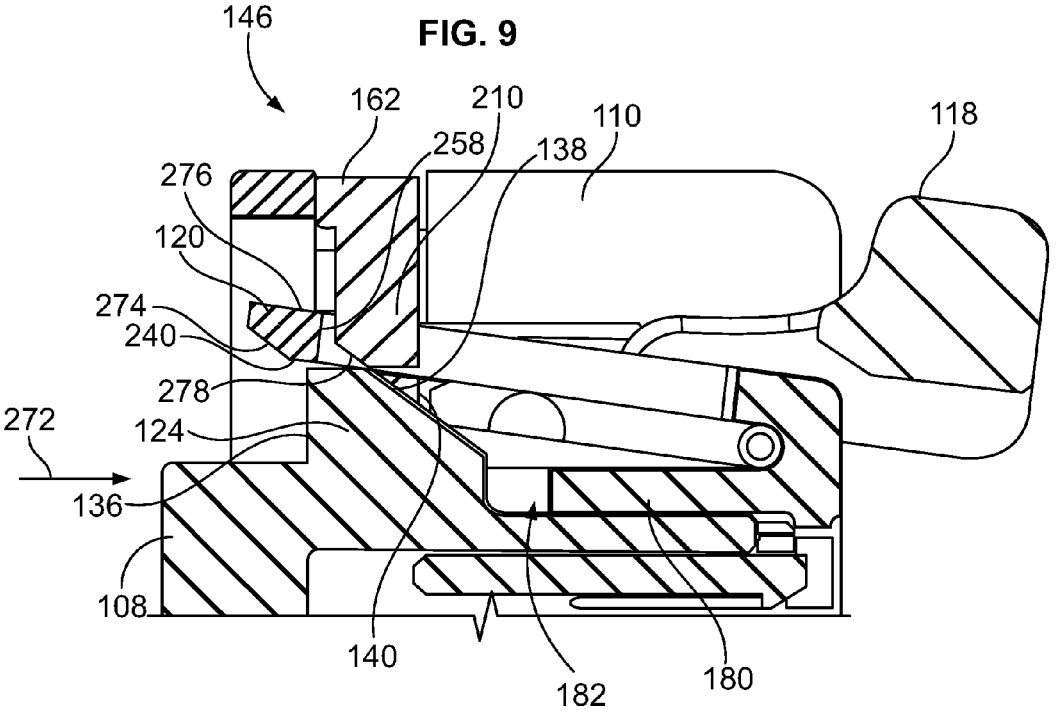
FIG. 10 is a cross-sectional view of a portion of a male housing of a male connector of the connector system being loaded in the housing assembly of the female connector according to an embodiment.

FIG. 10 is a cross-sectional view of a portion of the male housing 108 of the male connector 102 (shown in FIG. 1) being loaded in the housing assembly 146 of the female connector 104 (FIG. 1) according to an embodiment. The cross-section is taken along line 9-9 shown in FIG. 3. As the male housing 108 is loaded in the socket 106 (shown in FIG. 1), the rib 124 is received in the notch 182 of the platform 180. The ramp 140 of the rib 124 deflects the primary latch 120 upwards as the rib 124 moves in a mating direction 272 along the mating axis 112 (shown in FIG. 1). For example, the ramp 140 may first engage a beveled front edge 274 of the primary latch 120 that is complementary to the angle of the ramp 140. In the illustrated stage, the primary latch 120 is in a fully-deflected position, such that the bottom side 240 of the latch 120 rests on a planar crest 276 of the top side 138 of the rib 124 that is between the ramp 140 and the catch surface 136. As the rib 124 moves beyond the latching surface 258 of the primary latch 120, the ramp 140 engages the post 210 of the actuator 162. In the illustrated embodiment, the post 210 has a beveled bottom edge 278 that complements the ramp 140. Thus, movement of the male housing 108 in the mating direction 272 causes the beveled bottom edge 278 to slide along the ramp 140 to gradually lift the actuator 162 towards the clearance position.

The CPA element 118 in FIG. 10 is in the released position and is pivoted relative to the housing 110. The pivoting of the CPA element 118 may be used to deflect the primary latch 120 instead of, or in addition to, the movement of the rib 124 of the male housing 108. For example, the CPA element 118 may be pivoted to deflect the latch 120 upwards out of the path of the rib 124, such that the rib 124 does not engage the latch 120 as the male housing 108 is moved in the mating direction 272. The CPA element 118 also may be pivoted such that only a top portion of the ramp 140 of the rib 124 engages the latch 120, and, as such, both the CPA element 118 and the rib 124 apply forces on the primary latch 120 to deflect the latch 120. Although the CPA element 118 is shown in a pivoted state, it is understood that the CPA element 118 does not need to be pivoted during the mating operation, as the male housing 108 does not require the assistance of the CPA element 118 to deflect the primary latch 120.

Figure 11:
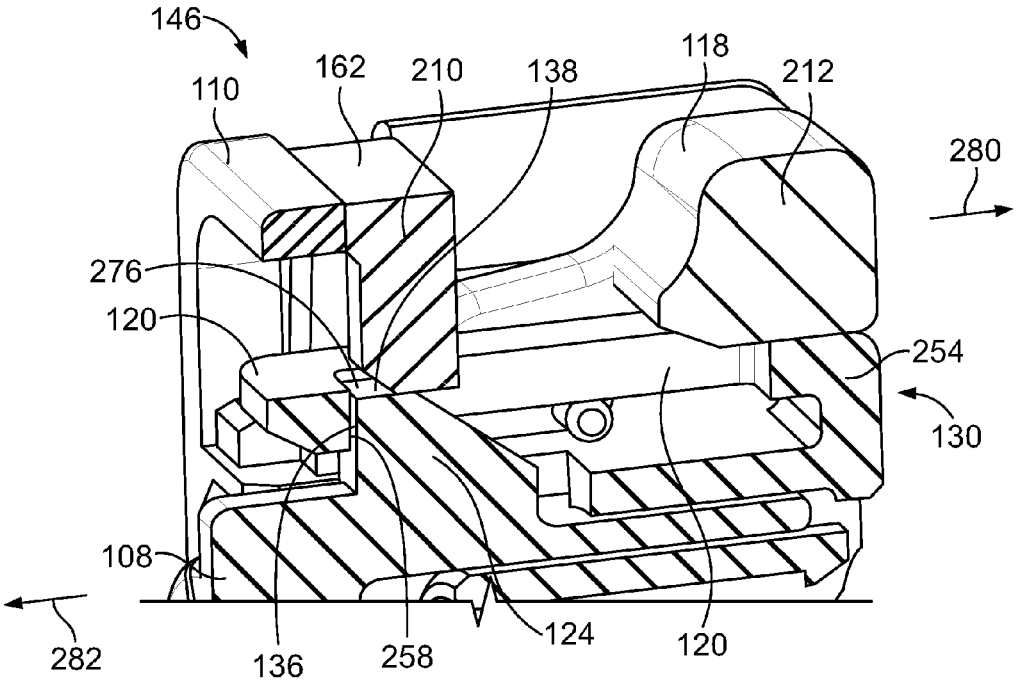
FIG. 11 is a cross-sectional view of a portion of the housing assembly and the male housing in the final mated stage taken along line 9-9 shown in FIG. 3.
Figure 12:
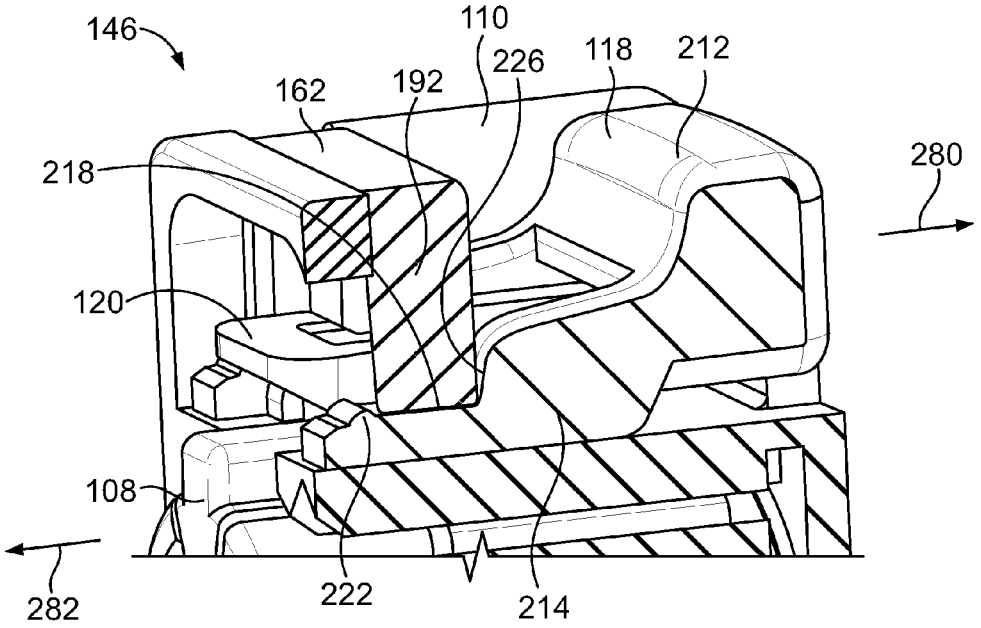
FIG. 12 is a cross-sectional view of a portion of the housing assembly and the male housing in the final mated stage taken along line 8-8 shown in FIG. 3.

FIGS. 11-13 illustrate various views of portions of the housing assembly 146 and the male housing 108 in the final mated stage schematically shown in FIG. 6, in which the actuator 162 is in the clearance position and the CPA element 118 is in the locked position. FIG. 11 is a cross-sectional view of a portion of the housing assembly 146 and the male housing 108 taken along line 9-9 shown in FIG. 3. FIG. 12 is a cross-sectional view of a portion of the housing assembly 146 and the male housing 108 taken along line 8-8 shown in FIG. 3. FIG. 13 is a side view of a portion of the housing assembly 146.

Referring to FIG. 11, the male housing 108 is fully loaded in the female housing 110 such that the primary latch 120 is undeflected and the latching surface 258 of the primary latch 120 engages the catch surface 136 of the rib 124 to secure the female housing 110 to the male housing 108. The post 210 of the actuator 162 rests on the crest 276 along the top side 138 of the rib 124 which holds the actuator 162 in the clearance position. The CPA element 118 has been allowed to move to the locked position from the released position because the actuator 162 is in the clearance position. In the locked position, at least a majority of the base 212 of the CPA element 118 is disposed above the primary latch 120 and does not protrude rearward from the rear end 130 of the housing 110. In such a position, the CPA element 118 is not pivotable because the base 212 abuts the latch 120 and/or the shoulder 254 to block such movement.

In FIG. 12, the cross-section extends through the first leg 192 of the actuator 162 and the first runner 214 of the CPA element 118. The illustrated embodiment resembles the schematic shown in FIG. 6. The first leg 192 sits on the top side 218 of the runner 214 between the detent 222 and the step 226. FIG. 13 shows the cantilevered beam 184 of the first side wall 172 in a fully deflected state. For example, the force that the male housing 108 exerts on the actuator 162 to raise the actuator 162 to the clearance position overcomes the downward biasing force exerted by the cantilevered beam 184 on the ledge 202 of the actuator 162. The cantilevered beam 184 is deflected upwards towards the top end 176 of the housing 110 relative to the position of the beam 184 shown in FIG. 7 when the actuator 162 is in the blocking position. The cantilevered beam 184 maintains the biasing force on the ledge 202 such that the cantilevered beam 184 moves the actuator 162 from the clearance position to the blocking position once the force exerted by the male housing 108 on the actuator 162 is removed.

In an embodiment, the male housing 108 can be uncoupled and removed from the female housing 110 using the CPA element 118. For example, referred to FIGS. 11 and 12, the CPA element 118 can be moved from the locked position to the released position by engaging the base 212 and sliding the CPA element 118 in an unlocking direction 280 towards the released position. The detent 222 engages the actuator 162 and provides a small amount of resistance that gives sensory feedback to the operator as the detent 222 moves past the actuator 162. Once in the released position, the CPA element 118 is pivoted, as shown in FIG. 10, to lift the primary latch 120 such that the latching surface 258 clears the catch surface 136 of the rib 124. With the latching surface 258 of the deflected primary latch 120 disposed above the catch surface 136, the male housing 108 is able to be moved in an un-mating direction 282 relative to the female housing 110 to remove the male connector 102 (shown in FIG. 1) from the female connector 104 (FIG. 1).

Figure 14:
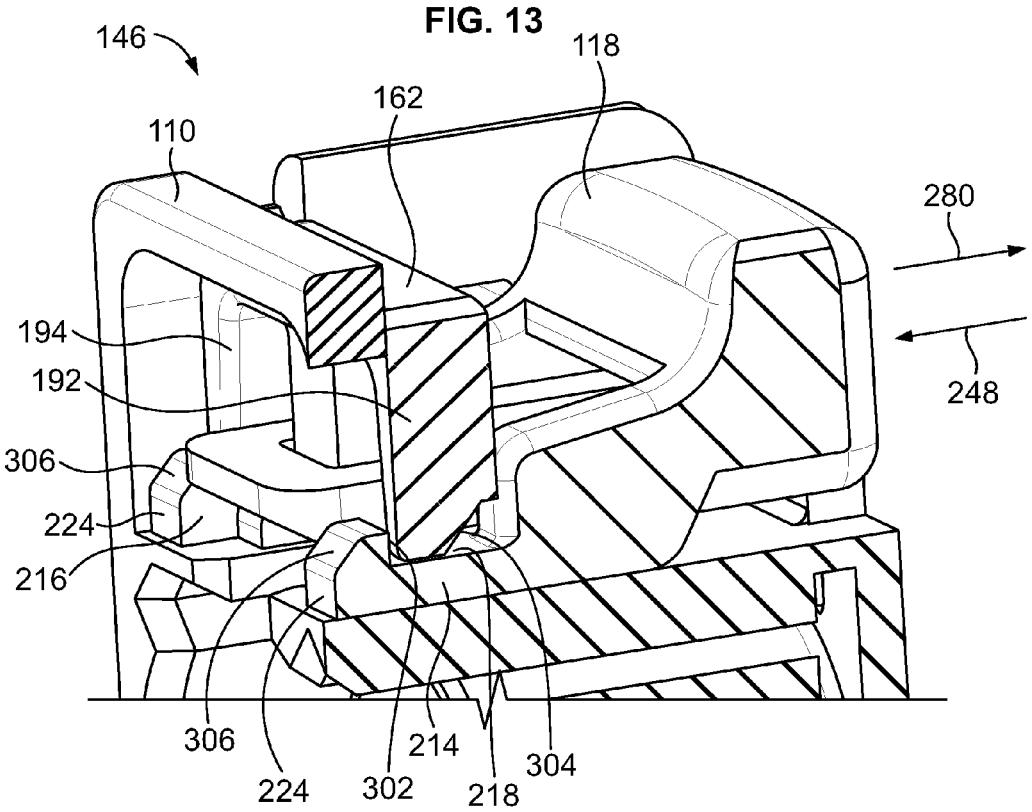
FIG. 14 is a cross-sectional view of a portion of the housing assembly in a pre-mated stage taken along line 8-8 shown in FIG. 3 according to an alternative embodiment of the housing assembly.

FIG. 14 is a cross-sectional view of a portion of the housing assembly 146 in a pre-mated stage taken along line 8-8 shown in FIG. 3 according to an alternative embodiment of the housing assembly 146. Unlike the embodiments shown in FIGS. 4-13, in the illustrated embodiment the released position of the CPA element 118 represents an assurance position of the connector system 100 (shown in FIG. 1) that indicates that the male connector 102 and female connector 104 (both shown in FIG. 1) are fully mated together. FIG. 14 represents a pre-mated stage prior to the male connector 102 being received in the housing 110. The actuator 162 is in a blocking position, and the CPA element 118 is in the locked position. The actuator 162 in the blocking position blocks movement of the CPA element 118 from the locked position to the released position. For example, the first runner 214 includes a catch 302 in place of the detent 222 (shown in FIG. 12). In the blocking position according to this embodiment, the first leg 192 engages the top side 218 of the first runner 214, so attempted movement of the CPA element 118 in the unlocking direction 280 towards the released position is blocked by the catch 302 abutting against the leg 192. Only displacement of the actuator 162 upwards from the blocking position to the clearance position allows the CPA element 118 to slide in the unlocking direction 280 because the catch 302 moves under the leg 192.

In an embodiment, after removing the male connector 102 (shown in FIG. 1) from the housing 110, the housing assembly 146 can be reset by moving the CPA element 118 in the locking direction 248 back to the locked position. In order for the distal end 224 of the runners 214, 216 to extend past the actuator 162, the legs 192, 194 define beveled rear edges 304 (only the edge 304 of the first leg 192 is visible in FIG. 14). The runners 214, 216 define complementary beveled front edges 306 that are configured to engage the beveled rear edges 304 to lift the actuator 162 out of the path of the runners 214, 216 as the CPA element 118 is moved in the locking direction 248 relative to the actuator 162.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a front end and a rear end, the housing defining a socket at the front end that is configured to receive a mating connector therein, the housing further including a deflectable primary latch that is cantilevered and connected to the housing at a shoulder;

a connector position assurance (CPA) element mounted on the housing, the CPA element being slidable relative to the housing between a released position and a locked position, the CPA element including a base and at least a first runner extending frontward from the base, the base protruding rearward beyond the shoulder of the housing when in the released position, a portion of the first runner extending under the primary latch frontward of the shoulder, wherein the CPA element in the released position is pivotable relative to the housing and the primary latch thereof such that downward movement of the base rearward of the shoulder causes the portion of the CPA element under the primary latch to lift the primary latch in an upward direction away from the socket; and an actuator mounted on the housing in operable engagement with the CPA element, the actuator having at least a first leg, the actuator being movable between a blocking position and a clearance position, the first leg of the actuator engaging the first runner when the actuator is in the blocking position to mechanically block the CPA element from being moved between the released position and the locked position, the CPA element being movable between the released position and the locked position when the actuator is in the clearance position;

wherein the actuator is moved from the blocking position to the clearance position by the mating connector as the mating connector is loaded into the socket, the actuator attaining the clearance position responsive to the mating connector being fully loaded in the housing.

2. The electrical connector of claim 1, wherein the deflectable primary latch frontward of the shoulder is configured to be deflected upward away from the socket by a rib of the mating connector as the mating connector is loaded into the socket, the primary latch having a latching surface configured to engage a catch surface of the rib when the mating connector is fully loaded in the socket to secure the mating connector to the housing.

3. The electrical connector of claim 2, wherein the actuator is engaged by the rib of the mating connector as the mating connector is loaded into the socket, the actuator being held in the clearance position by a top side of the rib as the catch surface of the rib engages the latching surface of the primary latch when the mating connector is fully loaded in the socket, wherein the downward movement of the base causes the portion of the CPA element to lift the primary latch upward over the rib of the mating connector to at least one of secure the mating connector to the housing or disconnect the mating connector from the housing.

4. The electrical connector of claim 1, wherein the CPA element in the released position is pivotable about a fulcrum disposed between a distal end of the first runner and the base, the fulcrum discrete from the shoulder of the housing.

5. The electrical connector of claim 4, wherein the shoulder protrudes outward from a platform of the housing, the fulcrum is a peg of the CPA element that extends from the first runner and is disposed between the primary latch and the platform.

6. The electrical connector of claim 1, wherein the first runner of the CPA element slides along a platform of the housing, the first leg of the actuator engaging the platform in a path of the first runner when the actuator is in the blocking position and the CPA element is in the released position such that the first leg blocks movement of a distal end of the first runner of the CPA element from the released position towards the locked position, the first leg being spaced apart vertically from the platform when the actuator is in the clearance position such that the distal end of the first runner is allowed to slide under the first leg towards the locked position.

7. The electrical connector of claim 6, wherein, when the CPA element is in the locked position, the distal end of the first runner is disposed beyond the first leg of the actuator and a bottom of the first leg engages a top side of the first runner between the distal end and the base of the CPA element.

8. The electrical connector of claim 6, wherein the first runner includes a detent that protrudes from a top side of the first runner between the distal end and the base of the CPA element, the detent disposed frontward of the first leg when the CPA element is in the locked position and the actuator is in the clearance position, the detent configured to abut against a front edge of the first leg as the CPA element moves from the locked position towards the released position.

9. The electrical connector of claim 1, wherein the actuator includes a ledge protruding from an outer side of the first leg, the housing including a cantilevered beam that engages a top of the ledge, the cantilevered beam biasing the actuator towards the blocking position.

10. The electrical connector of claim 1, wherein the socket of the housing is oriented along a mating axis such that the mating connector is loaded in the socket along the mating axis, the CPA element sliding parallel to the mating axis between the released position and the locked position, the actuator moving along a vertical axis between the blocking position and the clearance position, the vertical axis being orthogonal to the mating axis.

11. The electrical connector of claim 1, wherein the actuator further includes a second leg that extends parallel to and in the same direction as the first leg, the CPA element further including a second runner extending from the base parallel to and in the same direction as the first runner, the second leg engaging the second runner when the actuator is in the blocking position to mechanically block the CPA element from being moved between the released position and the locked position.

12. The electrical connector of claim 11, wherein the first and second legs of the actuator extend from opposite ends of a cross-bar of the actuator, the actuator further including a post disposed between the first and second legs, the post extending from the cross-bar in the same direction as the first and second legs, the post being engaged by the mating connector as the mating connector is loaded into the socket to move the actuator towards the clearance position.

13. An electrical connector comprising:

a housing having a front end and defining a socket at the front end that is configured to receive a mating connector therein, the housing further including a deflectable primary latch that engages a catch of the mating connector when the mating connector is fully loaded in the socket to secure the mating connector to the housing;

a connector position assurance (CPA) element mounted on the housing, the CPA element being slidable relative to the housing between a released position and a locked position, the CPA element in the released position being pivotable relative to the housing about a fulcrum, the CPA element including a base and at least a first runner extending from the base, a portion of the first runner between the fulcrum and a distal end of the first runner extending under the primary latch, wherein downward movement of the base pivots the CPA element such that the portion of the first runner lifts the primary latch over the catch of the mating connector to at least one of secure the mating connector to the housing or disconnect the mating connector from the housing; and an actuator mounted on the housing in operable engagement with the CPA element, the actuator being movable relative to the primary latch and the CPA element between a blocking position and a clearance position that is distinct from the blocking position, the actuator in the blocking position being configured to engage the first runner to mechanically block the CPA element from being moved between the released position and the locked position, the CPA element being movable between the released position and the locked position when the actuator is in the clearance position;

wherein the actuator is moved from the blocking position to the clearance position by the mating connector as the mating connector is loaded into the socket, the actuator attaining the clearance position responsive to the mating connector being fully loaded in the housing.

14. The electrical connector of claim 13, wherein the primary latch extends forward from a rear end of the housing, the primary latch having a latching surface configured to engage the catch of the mating connector when the mating connector is fully loaded in the housing, the primary latch defining an aperture therethrough that receives the catch of the mating connector, the latching surface being a rear-facing front wall of the aperture.

15. The electrical connector of claim 13, wherein when the CPA element is in the released position, the base of the CPA element projects rearward beyond a rear end of the housing.

16. The electrical connector of claim 13, wherein the CPA element in the locked position is not pivotable relative to the housing.

17. The electrical connector of claim 13, wherein the primary latch extends from a shoulder that protrudes outward from a platform of the housing, the fulcrum being a peg of the CPA element that extends from the first runner between the primary latch and the platform.

18. A connector system comprising:

a first electrical connector having a male housing extending from a mating end to a back end, the male housing including a rib protruding outward from an outer surface thereof; and a second electrical connector comprising:

a female housing extending from a front end to a rear end, the female housing defining a socket that is open at the front end, the socket configured to receive the male housing therein to mate the first and second electrical connectors, the female housing further including a deflectable primary latch that defines an aperture therethrough, a rear-facing front wall of the aperture defining a latching surface configured to engage a catch surface of the rib of the male housing when the male housing is fully loaded in the female housing to secure the male housing in the socket;

a connector position assurance (CPA) element mounted on the female housing, the CPA element being slidable relative to the female housing between a released position and a locked position, the CPA element including a base and at least a first runner extending from the base; and an actuator mounted on the female housing in operable engagement with the CPA element, the actuator being movable between a blocking position and a clearance position, the actuator being biased towards the blocking position, the actuator having at least a first leg and a post, the post extending into the aperture of the primary latch and the first leg disposed outside of the aperture, the first leg configured to engage the first runner when the actuator is in the blocking position to mechanically block the CPA element from being moved between the released position and the locked position, the CPA element being movable between the released position and the locked position when the actuator is in the clearance position;

wherein, as the male housing is being loaded into the socket, the rib is received in the aperture of the primary latch and engages the post of the actuator to move the actuator from the blocking position to the clearance position, the actuator attaining the clearance position responsive to the male housing being fully loaded in the female housing.

19. The connector system of claim 18, wherein the first runner of the CPA element slides along a platform of the female housing, the first leg of the actuator engaging the platform in a path of the first runner when the actuator is in the blocking position such that the first leg blocks movement of a distal end of the first runner from the released position to the locked position, the first leg of the actuator being spaced apart vertically from the platform when the actuator is in the clearance position such that the distal end of the first runner is allowed to slide under the first leg from the released position towards the locked position.

20. The connector system of claim 18, wherein the male housing of the first electrical connector is loaded into the socket of the female housing along a mating axis, the CPA element sliding parallel to the mating axis between the released and locked positions, the actuator moving along a vertical axis between the blocking position and the clearance position, the vertical axis being orthogonal to the mating axis.

* * * * *